US007343906B2

(12) United States Patent
Ozawa

(10) Patent No.: US 7,343,906 B2
(45) Date of Patent: Mar. 18, 2008

(54) WATER JET PROPULSION BOAT

(75) Inventor: Shigeyuki Ozawa, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/154,490

(22) Filed: Jun. 16, 2005

(65) Prior Publication Data

US 2005/0279335 A1 Dec. 22, 2005

(30) Foreign Application Priority Data

Jun. 16, 2004 (JP) ..... 2004-178645

(51) Int. Cl.
*F02B 33/00* (2006.01)
*F02B 29/04* (2006.01)

(52) U.S. Cl. ..... 123/559.1; 123/563; 123/568.11; 60/323; 440/88 A; 440/89 R

(58) Field of Classification Search ..... 123/559.1, 123/561, 563, 565, 198 E, 568.11; 60/609, 60/611, 323; 440/88 A, 89 R
See application file for complete search history.

(56) References Cited

U.S. PATENT DOCUMENTS

| | | | |
|---|---|---|---|
| 1,871,662 | A | 8/1932 | Carrier |
| 1,876,948 | A | 9/1932 | Jahnke |
| 1,903,210 | A | 3/1933 | Carrier |
| 1,974,974 | A | 9/1934 | Puffer |
| 2,366,365 | A | 1/1945 | Sorensen |
| 2,406,388 | A | 8/1946 | Larrecq |
| 2,565,060 | A | 8/1951 | Beardsley et al. |
| 2,828,907 | A | 4/1958 | Oehrli |
| 2,847,186 | A | 4/1958 | Anderson et al. |
| 2,973,894 | A | 3/1961 | Kimball et al. |
| 3,554,322 | A | 1/1971 | Deutschmann et al. |
| 3,703,877 | A | 11/1972 | Ueda |
| 4,010,717 | A | 3/1977 | Taplin |
| 4,035,171 | A | 7/1977 | Reed et al. |

(Continued)

FOREIGN PATENT DOCUMENTS

| | | |
|---|---|---|
| FR | 1263608 | 5/1996 |

(Continued)

OTHER PUBLICATIONS

Co-Pending U.S. Appl. No. 11/153,940, filed Jun. 16, 2005. Title: Water Jet Propulsion Boat. Inventor: Shigeyuki Ozawa.

(Continued)

*Primary Examiner*—Willis R. Wolfe
*Assistant Examiner*—Johnny H. Hoang
(74) *Attorney, Agent, or Firm*—Knobbe, Martens, Olson & Bear, LLP

(57) ABSTRACT

A watercraft can include an engine having a crankshaft with its output end extending rearward of a crankcase and a supercharger for compressing air feeding it to the engine. The supercharger can be located forward of a rear end of the crankcase. An exhaust pipe, designed to discharge combustion gas out of the watercraft, can be disposed above the supercharger. Forward of the supercharger, an intake box having an intake duct can be provided. An intercooler can be located beside the supercharger, through which the supercharger feeds the compressed air toward the engine.

17 Claims, 12 Drawing Sheets

U.S. PATENT DOCUMENTS

| | | | | |
|---|---|---|---|---|
| 4,068,612 | A | | 1/1978 | Meiners |
| 4,198,217 | A | | 4/1980 | Erdmannsdorfer |
| 4,212,659 | A | | 7/1980 | Magrini |
| 4,267,811 | A | | 5/1981 | Springer |
| 4,300,488 | A | | 11/1981 | Cser |
| 4,319,657 | A | | 3/1982 | Nomura |
| 4,321,896 | A | | 3/1982 | Kasting |
| 4,326,374 | A | | 4/1982 | Streb |
| 4,353,211 | A | | 10/1982 | Cser et al. |
| 4,412,520 | A | | 11/1983 | Mitsuyasu et al. |
| 4,422,295 | A | | 12/1983 | Minami et al. |
| 4,459,808 | A | | 7/1984 | Rydquist et al. |
| 4,475,617 | A | | 10/1984 | Minami et al. |
| 4,496,019 | A | | 1/1985 | Tanaka |
| 4,512,152 | A | | 4/1985 | Asaba |
| 4,513,725 | A | | 4/1985 | Minami et al. |
| RE31,877 | E | | 5/1985 | Nomura |
| 4,519,373 | A | | 5/1985 | Hardy et al. |
| 4,538,556 | A | | 9/1985 | Takeda |
| 4,553,515 | A | | 11/1985 | King et al. |
| 4,630,446 | A | | 12/1986 | Iwai et al. |
| 4,633,826 | A | | 1/1987 | Tominaga et al. |
| 4,662,323 | A | | 5/1987 | Moriya |
| 4,674,457 | A | | 6/1987 | Berger et al. |
| 4,677,826 | A | | 7/1987 | Iwai et al. |
| 4,678,441 | A | | 7/1987 | Murase |
| 4,709,682 | A | | 12/1987 | Kato |
| 4,712,517 | A | | 12/1987 | Anno et al. |
| 4,718,396 | A | | 1/1988 | Shimada et al. |
| 4,723,526 | A | | 2/1988 | Horiuchi et al. |
| 4,738,229 | A | | 4/1988 | Wada et al. |
| 4,741,302 | A | | 5/1988 | Oda et al. |
| 4,760,703 | A | | 8/1988 | Minami et al. |
| 4,773,361 | A | | 9/1988 | Toki et al. |
| 4,781,553 | A | | 11/1988 | Nomura et al. |
| 4,796,574 | A | | 1/1989 | Fujii et al. |
| 4,797,068 | A | | 1/1989 | Hayakawa et al. |
| 4,827,722 | A | | 5/1989 | Torigai |
| 4,848,170 | A | | 7/1989 | Inagaki et al. |
| 4,887,692 | A | | 12/1989 | Outani et al. |
| 4,896,734 | A | | 1/1990 | Horiuchi et al. |
| 4,900,343 | A | | 2/1990 | Minami et al. |
| 4,936,278 | A | | 6/1990 | Umeda |
| 4,938,664 | A | | 7/1990 | Zinsmeyer |
| 4,955,352 | A | | 9/1990 | Takeda |
| 4,972,807 | A | | 11/1990 | Morishita |
| 4,982,682 | A | | 1/1991 | Hattori |
| 4,984,528 | A | | 1/1991 | Kobayashi |
| 4,984,974 | A | | 1/1991 | Naya et al. |
| 4,989,409 | A | | 2/1991 | Nakase et al. |
| 4,991,532 | A | | 2/1991 | Locke |
| 5,002,021 | A | | 3/1991 | Nakata et al. |
| 5,009,204 | A | | 4/1991 | Ishii |
| 5,014,816 | A | | 5/1991 | Dear et al. |
| 5,031,591 | A | | 7/1991 | Shinoda et al. |
| 5,060,622 | A | * | 10/1991 | Suzuki ..... 123/559.1 |
| 5,088,280 | A | | 2/1992 | Scott-Scott et al. |
| 5,094,193 | A | | 3/1992 | Yoshikawa |
| 5,095,859 | A | | 3/1992 | Iwata et al. |
| 5,130,014 | A | | 7/1992 | Volz |
| 5,133,307 | A | | 7/1992 | Kurihara |
| 5,136,547 | A | | 8/1992 | Laukien |
| 5,136,993 | A | | 8/1992 | Ampferer et al. |
| 5,143,028 | A | | 9/1992 | Takahashi |
| 5,158,427 | A | | 10/1992 | Shirai |
| 5,159,903 | A | | 11/1992 | Takahashi |
| RE34,226 | E | | 4/1993 | Morishita |
| 5,215,164 | A | | 6/1993 | Shibata |
| 5,230,320 | A | | 7/1993 | Hitomi et al. |
| 5,239,950 | A | | 8/1993 | Takahashi |
| 5,243,945 | A | | 9/1993 | Katoh et al. |
| 5,253,618 | A | | 10/1993 | Takahashi et al. |
| 5,261,356 | A | | 11/1993 | Takahashi et al. |
| 5,293,846 | A | | 3/1994 | Takahashi |
| 5,299,423 | A | | 4/1994 | Shiozawa et al. |
| 5,330,374 | A | | 7/1994 | Ishino |
| 5,340,343 | A | | 8/1994 | Kawamukai et al. |
| 5,340,344 | A | | 8/1994 | Mineo et al. |
| 5,365,908 | A | | 11/1994 | Takii et al. |
| 5,377,629 | A | | 1/1995 | Brackett et al. |
| 5,377,634 | A | | 1/1995 | Taue |
| 5,389,022 | A | | 2/1995 | Kobayashi |
| 5,390,621 | A | | 2/1995 | Hattori et al. |
| RE34,922 | E | | 5/1995 | Hattori et al. |
| 5,438,946 | A | | 8/1995 | Kobayashi |
| 5,456,230 | A | | 10/1995 | VanRens et al. |
| 5,477,838 | A | * | 12/1995 | Schlunke et al. ..... 123/559.1 |
| 5,503,117 | A | | 4/1996 | Saito |
| 5,513,606 | A | | 5/1996 | Shibata |
| 5,529,027 | A | | 6/1996 | Okubo |
| 5,537,968 | A | | 7/1996 | Takahashi |
| 5,558,549 | A | | 9/1996 | Nakase et al. |
| 5,584,733 | A | | 12/1996 | Kobayashi |
| 5,586,922 | A | | 12/1996 | Kobayashi et al. |
| 5,603,301 | A | | 2/1997 | Sakurai et al. |
| 5,619,950 | A | | 4/1997 | Ikeda |
| 5,632,239 | A | | 5/1997 | Patyi et al. |
| 5,634,422 | A | | 6/1997 | Kobayashi et al. |
| 5,636,586 | A | | 6/1997 | Suganuma |
| 5,638,796 | A | | 6/1997 | Adams, III et al. |
| 5,647,779 | A | | 7/1997 | Nanami |
| 5,660,155 | A | | 8/1997 | Taue et al. |
| 5,660,571 | A | | 8/1997 | Nakayasu et al. |
| 5,664,515 | A | | 9/1997 | Hattori et al. |
| 5,671,703 | A | | 9/1997 | Otome et al. |
| 5,678,525 | A | | 10/1997 | Taue |
| 5,682,870 | A | | 11/1997 | Motoyama |
| 5,699,749 | A | | 12/1997 | Yamada et al. |
| 5,709,185 | A | | 1/1998 | Aizawa et al. |
| 5,709,186 | A | | 1/1998 | Taue |
| 5,709,198 | A | | 1/1998 | Sagisaka et al. |
| 5,743,206 | A | | 4/1998 | Hattori |
| 5,755,194 | A | | 5/1998 | Moorman et al. |
| 5,775,283 | A | | 7/1998 | Sawai et al. |
| 5,778,838 | A | | 7/1998 | Taue |
| 5,778,857 | A | | 7/1998 | Nakamura et al. |
| 5,797,778 | A | | 8/1998 | Ito et al. |
| 5,820,426 | A | | 10/1998 | Hale |
| 5,827,096 | A | | 10/1998 | Mineo |
| 5,829,402 | A | | 11/1998 | Takahashi et al. |
| 5,839,930 | A | | 11/1998 | Nanami et al. |
| 5,845,618 | A | | 12/1998 | Taue et al. |
| 5,846,102 | A | | 12/1998 | Nitta et al. |
| 5,855,193 | A | | 1/1999 | Takahashi |
| 5,899,778 | A | | 5/1999 | Hiraoka et al. |
| 5,902,161 | A | | 5/1999 | Nakase |
| 5,906,083 | A | | 5/1999 | Olsen et al. |
| 5,908,337 | A | | 6/1999 | Mashiko |
| 5,911,211 | A | * | 6/1999 | Uchida ..... 123/559.1 |
| 5,928,044 | A | | 7/1999 | Mineo |
| 5,934,070 | A | | 8/1999 | Lagelstorfer |
| 5,937,818 | A | | 8/1999 | Kawai et al. |
| 5,937,825 | A | | 8/1999 | Motose |
| 5,941,223 | A | | 8/1999 | Kato |
| 5,951,343 | A | | 9/1999 | Nanami et al. |
| 5,957,072 | A | | 9/1999 | Hattori |
| 5,960,770 | A | | 10/1999 | Taue et al. |
| 5,983,878 | A | | 11/1999 | Nonaka et al. |
| 6,009,705 | A | | 1/2000 | Arnott et al. |
| 6,015,320 | A | | 1/2000 | Nanami |
| 6,015,321 | A | | 1/2000 | Ozawa et al. |
| 6,016,782 | A | | 1/2000 | Henmi |
| 6,022,252 | A | | 2/2000 | Ozawa |
| 6,026,775 | A | | 2/2000 | Yamane |

| | | | |
|---|---|---|---|
| 6,029,638 | A | 2/2000 | Funai et al. |
| 6,041,758 | A | 3/2000 | Ishii |
| 6,055,959 | A | 5/2000 | Taue |
| 6,079,378 | A | 6/2000 | Taue et al. |
| 6,085,702 | A | 7/2000 | Ito |
| 6,099,371 | A | 8/2000 | Nozawa et al. |
| 6,149,477 | A | 11/2000 | Toyama |
| 6,171,380 | B1 | 1/2001 | Wood et al. |
| 6,205,987 | B1 | 3/2001 | Shigedomi et al. |
| 6,213,062 | B1 | 4/2001 | Kawase |
| 6,263,851 | B1 | 7/2001 | Henmi |
| 6,279,372 | B1 | 8/2001 | Zhang |
| 6,286,492 | B1 | 9/2001 | Kanno |
| 6,302,752 | B1 | 10/2001 | Ito et al. |
| 6,312,299 | B1 | 11/2001 | Henmi |
| 6,318,085 | B1 | 11/2001 | Torno et al. |
| 6,390,869 | B2 | 5/2002 | Korenjak et al. |
| 6,394,060 | B2 | 5/2002 | Nagai et al. |
| 6,415,759 | B2 | 7/2002 | Ohrnberger et al. |
| 6,447,351 | B1 | 9/2002 | Nanami |
| 6,453,890 | B1 | 9/2002 | Kageyama et al. |
| 6,497,596 | B1 | 12/2002 | Nanami |
| 6,516,789 | B1 | 2/2003 | Jones |
| 6,517,397 | B1 | 2/2003 | Gohara et al. |
| 6,544,086 | B2 | 4/2003 | Tscherne et al. |
| 6,568,376 | B2 | 5/2003 | Sonnleitner et al. |
| 6,591,819 | B2 | 7/2003 | Tscherne et al. |
| 6,601,528 | B2 | 8/2003 | Bilek et al. |
| 6,623,321 | B2 | 9/2003 | Ishino |
| 6,626,140 | B2 | 9/2003 | Aichinger et al. |
| 6,637,406 | B2 | 10/2003 | Yamada et al. |
| 6,640,754 | B1 | 11/2003 | Iida |
| 6,644,942 | B2 | 11/2003 | Rival et al. |
| 6,651,633 | B1 | 11/2003 | Jones |
| 6,663,366 | B2 | 12/2003 | Okada et al. |
| 6,672,918 | B2 | 1/2004 | Mashiko et al. |
| 6,746,288 | B2 | 6/2004 | Gokan |
| 6,769,942 | B2 | 8/2004 | Bourret et al. |
| 6,796,126 | B2 | 9/2004 | Hasegawa et al. |
| 6,810,855 | B2 | 11/2004 | Hasegawa et al. |
| 6,973,985 | B2 | 12/2005 | Yatagai et al. |
| 7,007,682 | B2 | 3/2006 | Takahashi et al. |
| 7,101,238 | B2 | 9/2006 | Aichinger et al. |
| 2001/0044352 | A1 | 11/2001 | Korenjak et al. |
| 2002/0025742 | A1 | 2/2002 | Berthiaume et al. |
| 2003/0015126 | A1 | 1/2003 | Gokan |
| 2005/0172919 | A1 | 8/2005 | Ozaki et al. |
| 2005/0204730 | A1 | 9/2005 | Tsukahara et al. |
| 2005/0247498 | A1 | 11/2005 | Pichler et al. |
| 2006/0243259 | A1 | 11/2006 | Takahashi |

FOREIGN PATENT DOCUMENTS

| | | |
|---|---|---|
| JP | 57-062929 | 4/1982 |
| JP | 57-062930 | 4/1982 |
| JP | 57-073817 | 5/1982 |
| JP | 57-073818 | 5/1982 |
| JP | 57-073820 | 5/1982 |
| JP | 57-083632 | 5/1982 |
| JP | 57-093627 | 6/1982 |
| JP | 57-105537 | 7/1982 |
| JP | 57-113922 | 7/1982 |
| JP | 57-113944 | 7/1982 |
| JP | 57-151019 | 9/1982 |
| JP | 57-171027 | 10/1982 |
| JP | 57-181931 | 11/1982 |
| JP | 57-183512 | 11/1982 |
| JP | 57-191421 | 11/1982 |
| JP | 57-203822 | 12/1982 |
| JP | 58-044221 | 3/1983 |
| JP | 58-053655 | 3/1983 |
| JP | 58-057023 | 4/1983 |
| JP | 58-082038 | 5/1983 |
| JP | 58-128925 | 8/1983 |
| JP | 58-170628 | 10/1983 |
| JP | 58-185927 | 10/1983 |
| JP | 58-185929 | 10/1983 |
| JP | 58-185930 | 10/1983 |
| JP | 58-185931 | 10/1983 |
| JP | 58-185932 | 10/1983 |
| JP | 58-192924 | 11/1983 |
| JP | 58-194695 | 11/1983 |
| JP | 59-018228 | 1/1984 |
| JP | 59-053229 | 3/1984 |
| JP | 59-176419 | 10/1984 |
| JP | 59-201932 | 11/1984 |
| JP | 59-220492 | 12/1984 |
| JP | 60-119328 | 6/1985 |
| JP | 60-150445 | 8/1985 |
| JP | 60-240522 | 11/1985 |
| JP | 60-240523 | 11/1985 |
| JP | 60-240524 | 11/1985 |
| JP | 60-240525 | 11/1985 |
| JP | 62-060926 | 11/1985 |
| JP | 61-126324 | 6/1986 |
| JP | 61-126325 | 6/1986 |
| JP | 61-215123 | 9/1986 |
| JP | 61-237824 | 10/1986 |
| JP | 01-119421 | 5/1989 |
| JP | 01-182560 | 7/1989 |
| JP | 01-211615 | 8/1989 |
| JP | 01-229786 | 9/1989 |
| JP | 01-232112 | 9/1989 |
| JP | 01-232113 | 9/1989 |
| JP | 01-232115 | 9/1989 |
| JP | 01-232116 | 9/1989 |
| JP | 01-232118 | 9/1989 |
| JP | 01-301917 | 12/1989 |
| JP | 01-301918 | 12/1989 |
| JP | 01-301919 | 12/1989 |
| JP | 01-313624 | 12/1989 |
| JP | 02-006289 | 1/1990 |
| JP | 02-016327 | 1/1990 |
| JP | 02-024282 | 1/1990 |
| JP | 02-024283 | 1/1990 |
| JP | 02-024284 | 1/1990 |
| JP | 02-070920 | 3/1990 |
| JP | 02-119636 | 5/1990 |
| JP | 02-175491 | 7/1990 |
| JP | 02-188624 | 7/1990 |
| JP | 02-201026 | 8/1990 |
| JP | 02-294520 | 12/1990 |
| JP | 03-021584 | 1/1991 |
| JP | 03-023317 | 1/1991 |
| JP | 03-047425 | 2/1991 |
| JP | 03-168352 | 7/1991 |
| JP | 03-179152 | 8/1991 |
| JP | 03-182626 | 8/1991 |
| JP | 03-182635 | 8/1991 |
| JP | 03-281939 | 12/1991 |
| JP | 04-203317 | 7/1992 |
| JP | 07-311626 | 11/1992 |
| JP | 05-141260 | 6/1993 |
| JP | 05-141262 | 6/1993 |
| JP | 05-332188 | 12/1993 |
| JP | 06-093869 | 4/1994 |
| JP | 06-212986 | 8/1994 |
| JP | 07-091264 | 4/1995 |
| JP | 07-145730 | 6/1995 |
| JP | 07-151006 | 6/1995 |
| JP | 07-317545 | 12/1995 |
| JP | 07-317555 | 12/1995 |
| JP | 07-317556 | 12/1995 |
| JP | 07-317557 | 12/1995 |
| JP | 08-028280 | 1/1996 |
| JP | 08-028285 | 1/1996 |

| | | |
|---|---|---|
| JP | 08-104286 | 4/1996 |
| JP | 08-104295 | 4/1996 |
| JP | 08-114122 | 5/1996 |
| JP | 08-114123 | 5/1996 |
| JP | 08-114124 | 5/1996 |
| JP | 08-114125 | 5/1996 |
| JP | 08-151926 | 6/1996 |
| JP | 08-151965 | 6/1996 |
| JP | 08-296449 | 12/1996 |
| JP | 08-319840 | 12/1996 |
| JP | 08-319901 | 12/1996 |
| JP | 09-184426 | 7/1997 |
| JP | 09-287465 | 11/1997 |
| JP | 09-287467 | 11/1997 |
| JP | 09-287470 | 11/1997 |
| JP | 09-287471 | 11/1997 |
| JP | 09-287472 | 11/1997 |
| JP | 09-287475 | 11/1997 |
| JP | 09-287486 | 11/1997 |
| JP | 10-008973 | 1/1998 |
| JP | 10-089079 | 4/1998 |
| JP | 10-008974 | 11/1998 |
| JP | 10-299525 | 11/1998 |
| JP | 2000-038968 | 2/2000 |
| JP | 3060489 | 4/2000 |
| JP | 2001-082160 | 3/2001 |
| JP | 2001-233276 | 8/2001 |
| JP | 2001-233277 | 8/2001 |
| JP | 2001-263076 | 9/2001 |
| JP | 2001-280144 | 10/2001 |
| JP | 2003-027952 | 1/2003 |
| JP | 2003-049654 | 2/2003 |
| JP | 2006-083713 | 3/2006 |

OTHER PUBLICATIONS

Co-pending U.S. Appl. No. 10/866,384, filed Jun. 11, 2004. Now published as US-2004-0253886 (enclosed). Title: Intake Manifold For Small Watercraft. Inventor: Mashiko.

Co-pending U.S. Appl. No. 11/186,477, filed Jul. 21, 2005. Now published as US-2006-0016437 (enclosed). Title: Intake System For Supercharged Engine. Inventor: Ozawa.

Co-pending U.S. Appl. No. 11/226,829, filed Sep. 12, 2005. Now published as US-2006-0054146 (enclosed). Title: Supercharger Lubrication Structure. Inventor: Ozawa.

Co-pending U.S. Appl. No. 11/226,497, filed Sep. 14, 2005. Now published as US-2006-0060170 (enclosed). Title: Supercharger Lubrication Structure. Inventor: Ozawa.

Co-pending U.S. Appl. No. 11/511,970, filed Aug. 29, 2006. Title: Small Planning Boat. Inventor: Mineo.

Co-pending U.S. Appl. No. 11/527,189, filed Sep. 26, 2006. Title: Installation Structure For Compressor. Inventor: Mineo.

* cited by examiner

WATER JET PROPULSION BOAT

PRIORITY INFORMATION

The present application is based on and claims priority under 35 U.S.C. § 119(a–d) to Japanese Patent Application No. 2004-178645, filed on Jun. 16, 2004, the entire contents of which is expressly incorporated by reference herein.

BACKGROUND OF THE INVENTIONS

1. Field of the Inventions

The present inventions relate to a water jet propulsion boat provided with a supercharger for feeding compressed air to an engine.

2. Description of the Related Art

Conventionally, water jet propulsion boats travel on the seawater or the like by driving a jet pump to draw in seawater from the bottom of a hull and eject it from the rear of a stern. Recently, this type of water jet propulsion boat has become available with a supercharger to improve engine output, more particularly, acceleration performance.

For example, Japanese Patent Publication No. JP-A-2003-27952 discloses a water jet propulsion unit having an engine disposed in the longitudinal direction of the hull body so that the supercharger is located rearwardly from a rear side of the engine. The supercharger and a rear end of a main gallery provided parallel to a crankshaft of the engine are connected via an oil feed pipe. This reduces the time period between engine start and oil feeding to the supercharger, which allows the supercharger to quickly and reliably operate.

SUMMARY OF THE INVENTIONS

An aspect of at least one of the embodiments disclosed herein includes the realization that components of a supercharger on a watercraft can become damaged by splashing water when such a supercharger is mounted with at least some of its components being disposed rearwardly from a rear side of the engine body. For example, water sometimes enters an engine compartment of the water jet propulsion boat. Then, if the water jet propulsion boat is accelerated, inertial force causes the water in the engine compartment to move rearwardly.

With the water in the rear portion of the engine compartment, the water can be stirred up and splash around due to rotations of a shaft that drive the jet pump of a coupling that connects an output shaft of the engine to the shaft. In this case, the water can be splashed onto the supercharger or components thereof. For example, the supercharger is connected to a portion of the engine and other induction system components so as to direct pressurized air into the body of the engine for combustion therein. As such, the water can cause irregular overheating or cooling of the joint portions of the supercharger, thereby in impairing sealing performance. This raises the likelihood of water to entering the supercharger from these joints and flowing into the engine.

Thus, in accordance with an embodiment, a watercraft comprises an engine, an intake passage configured to guide air to the engine, and an exhaust passage configured to guide exhaust gasses away from the engine. The engine can include a crankshaft, the crankshaft being connected to an output shaft so as to transmit power rearwardly from a rear end of a crankcase of the engine. Additionally, a supercharger is configured to compress air to feed the compressed air to the intake passage. The supercharger is located forward of the rear end of the crankcase in the watercraft.

In accordance with another embodiment, a watercraft comprises an engine, an intake system configured to guide air to the engine for combustion in the engine, and an exhaust system configured to guide exhaust gasses away from the engine. The engine can include a crankshaft, the crankshaft being connected to an output shaft so as to transmit power from a crankcase of the engine. A supercharger configured to compress air to feed the compressed air to the intake passage, wherein at least a portion of the exhaust system extends over the supercharger.

By arranging the exhaust system and supercharger as such, water, which splashes due to rotations of a coupling between the engine and a propulsion unit, is blocked from dropping onto the supercharger from above because the exhaust pipe placed above the supercharger blocks such water. The exhaust pipe thus protects the supercharger from the water dropping from above.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the following Figures.

DETAILED DESCRIPTION OF THE PREFERRED EMBODIMENT

Figure 1:
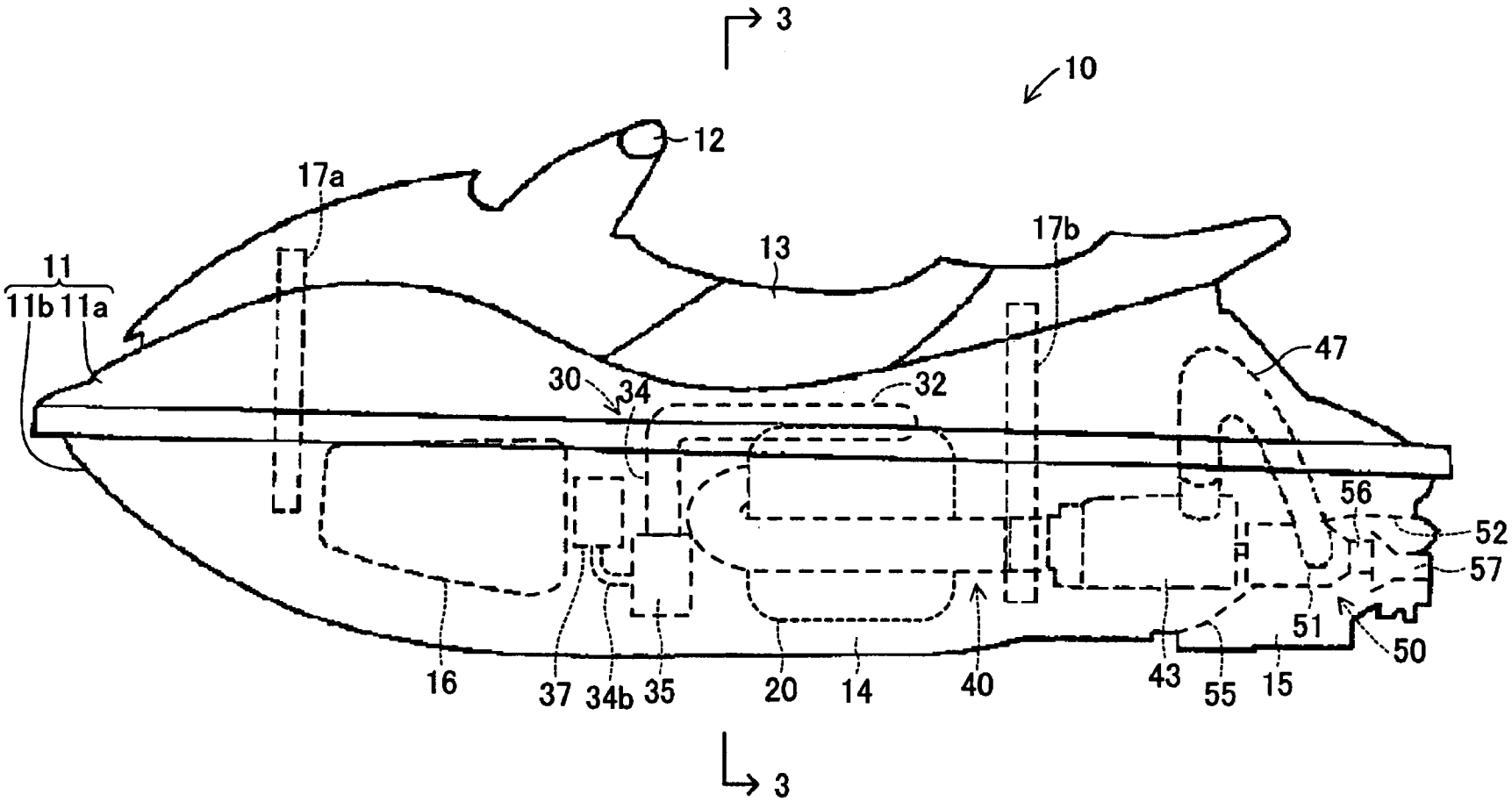
FIG. 1 is a side view of a watercraft according to a first embodiment.

FIG. 1 illustrates a personal watercraft 10 having an exhaust control mechanism in accordance with several embodiments. The exhaust control mechanism is disclosed in the context of a personal watercraft because it has particular utility in this context. However, the exhaust control mechanism can be used in other contexts, such as, for example, but without limitation, outboard motors, inboard/outboard motors, and for engines of other vehicles including land vehicles.

Figure 2:
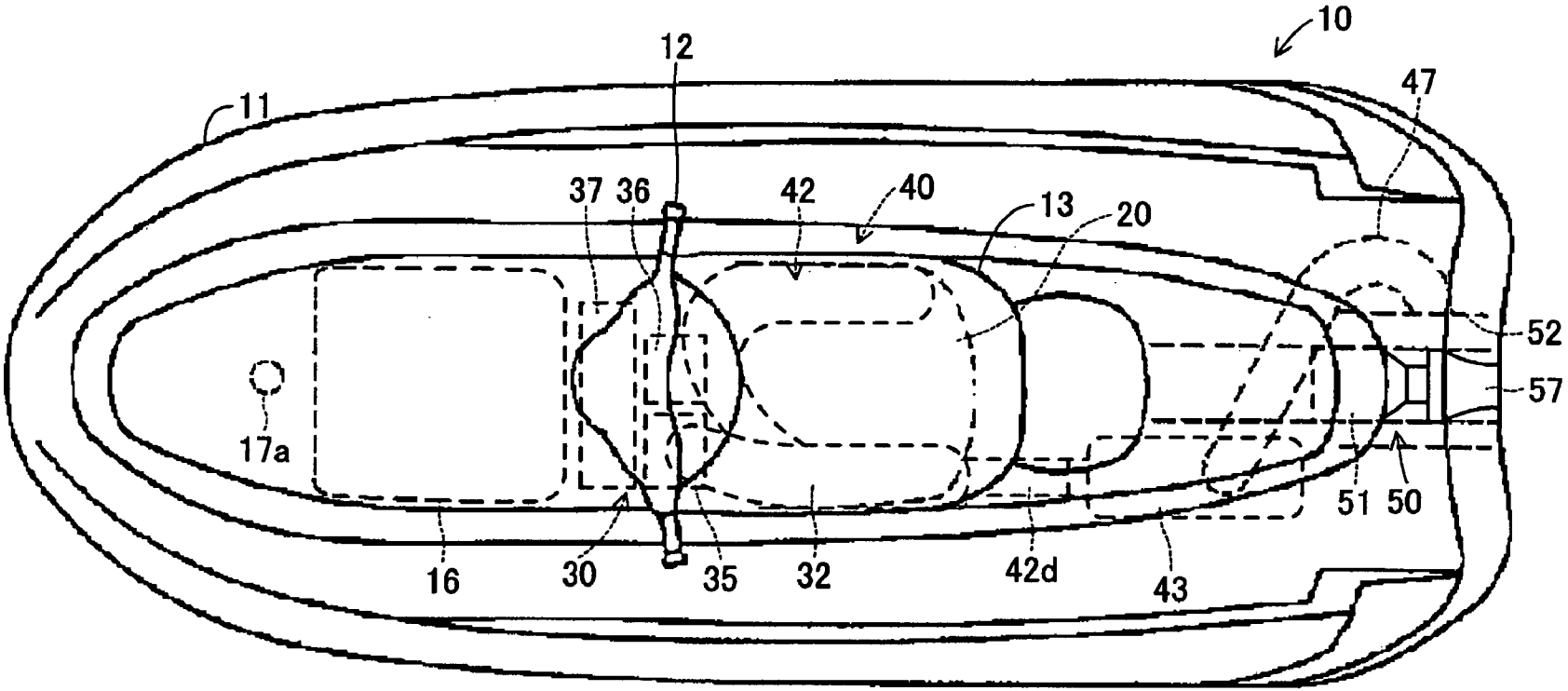
FIG. 2 is a top plan view of the watercraft shown in FIG. 1.

FIGS. 1 and 2 show a watercraft 10 according to an embodiment. The watercraft 10 can have a body 11 including a deck 11*a* and a hull 11*b* . The body 11 can have steering handlebars 12 located on the upper part of the body 11 and slightly in front of its center. A seat 13 can be located centrally of the upper part of the body 11.

The interior of the body 11 can include an engine compartment 14 formed along the front to the mid parts of the body 11. A fuel tank 16, an engine 20, an intake system 30 and an exhaust system 40, and optionally other components and systems can be disposed in the engine compartment 14.

A pump compartment 15 can be formed on the rear part of the body 11. A propulsion unit 50 including a jet pump 51 and optionally other components and systems can be provided in the pump compartment 15. The engine compartment 14 and the pump compartment 15 can be separate by a bulkhead (not shown).

At forward and rearward portions of the interior of the engine compartment 14, respective air ducts 17*a*, 17*b* can be provided for introducing the ambient air into the engine compartment 14. These air ducts 17*a*, 17*b* can be formed to extend generally vertically from the upper part of the body 11 to the bottom of the engine compartment 14, so that the outside air is drawn from their upper end through a waterproof structure (not shown) provided on the deck 11*a*, and introduced into the engine compartment 14 from their lower end.

A fuel tank 16 can be disposed forward of the engine compartment 14. Optionally, a bulkhead (not shown) can be disposed between the fuel tank 16 and the engine 20.

The illustrated engine 20 is a water-cooled, four-stroke, four-cylinder engine. However, this is merely one type of engine that can be used. Other types of engines can be used which operate on other types of combustion principles (e.g., diesel, rotary, two-stroke), have other cylinder configurations (V-type, W-type, horizontally opposed, etc.), and have other numbers of cylinders.

Figure 3:
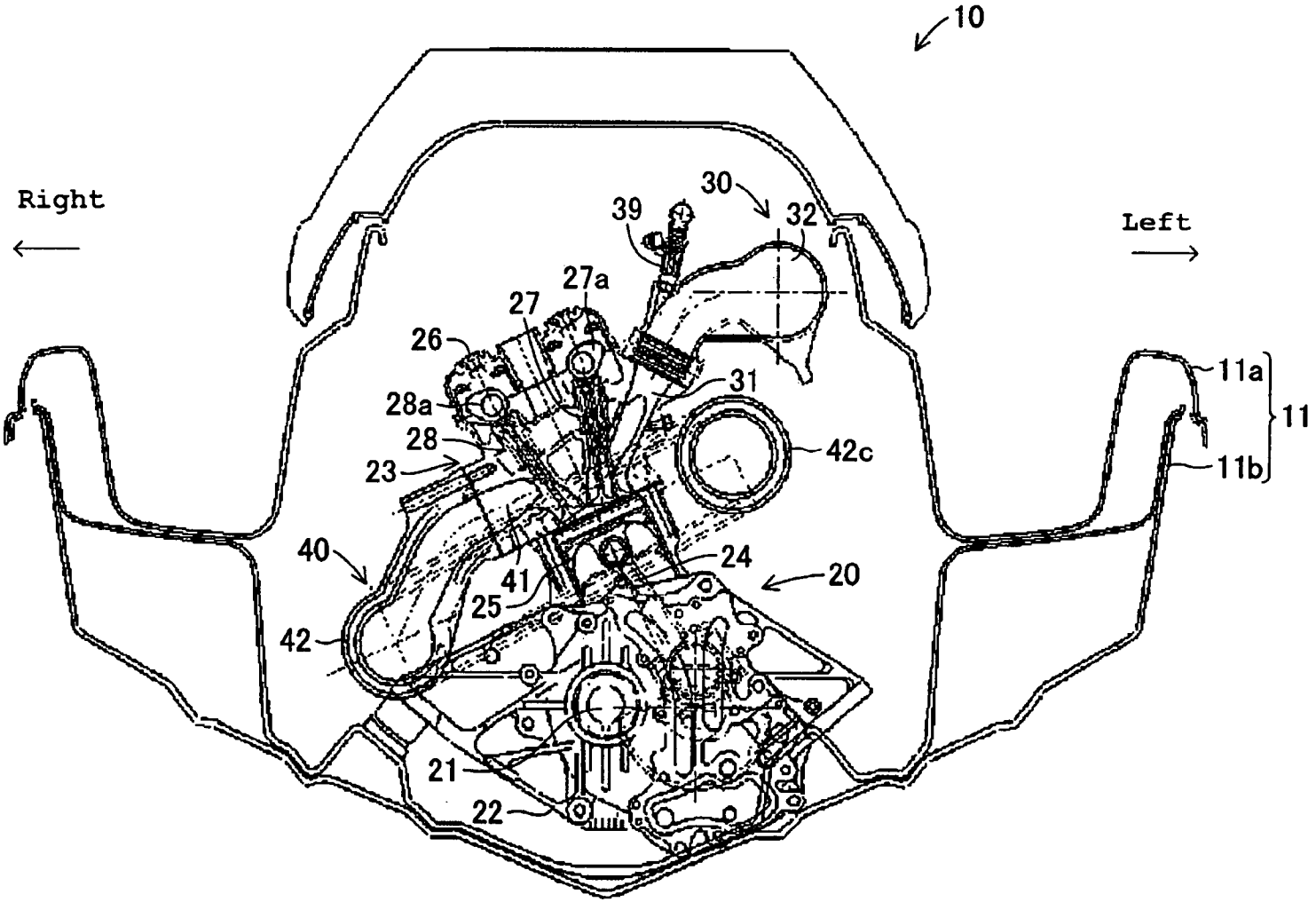
FIG. 3 is a sectional view taken along the line 3—3 of FIG. 1.

As shown in FIG. 3, an outer shell of an engine body is formed with a crankcase 22 in which a crankshaft 21 is housed, and a cylinder head 23 formed on the top of the crankcase 22. The engine 20 can be located with its upper part on the cylinder head 23 side and can be tilted toward the starboard side of the body 11.

The cylinder head 23 can house a piston 25, which is connected through a connecting rod 24 to the crankshaft 21, for up and down movement but slightly in the oblique direction. Such up and down movement of the piston 25 is transmitted to the crankshaft 21 to be transformed into rotary movement.

Each cylinder 26, formed above the cylinder head 23, can have an intake valve 27 and an exhaust valve 28, which are driven respectively by rotations of an intake camshaft 27*a* and an exhaust camshaft 28*a* connected to the crankshaft 21 via a timing belt (not shown). An inlet port, communicating with the intake valve 27 for each cylinder 26, can be connected to the intake system 30 including multi-furcated intake pipes 31 or intake passages of the invention. The intake valve 27 opens during the intake stroke to feed a mixture of air supplied by the intake system 30 via the intake port, and fuel supplied by a fuel supply system, which is described below, to the cylinder head 23, and closes during the exhaust stroke.

An exhaust port, which communicates with the exhaust valve 28, is connected to the exhaust system 40 including multi-furcated exhaust pipes 41 or exhaust passages. The exhaust valve 28 opens during the exhaust stroke to feed combustion gas discharged from the cylinder head 23 through the exhaust port to the exhaust system 40, and closes during the intake stroke.

Figure 4:
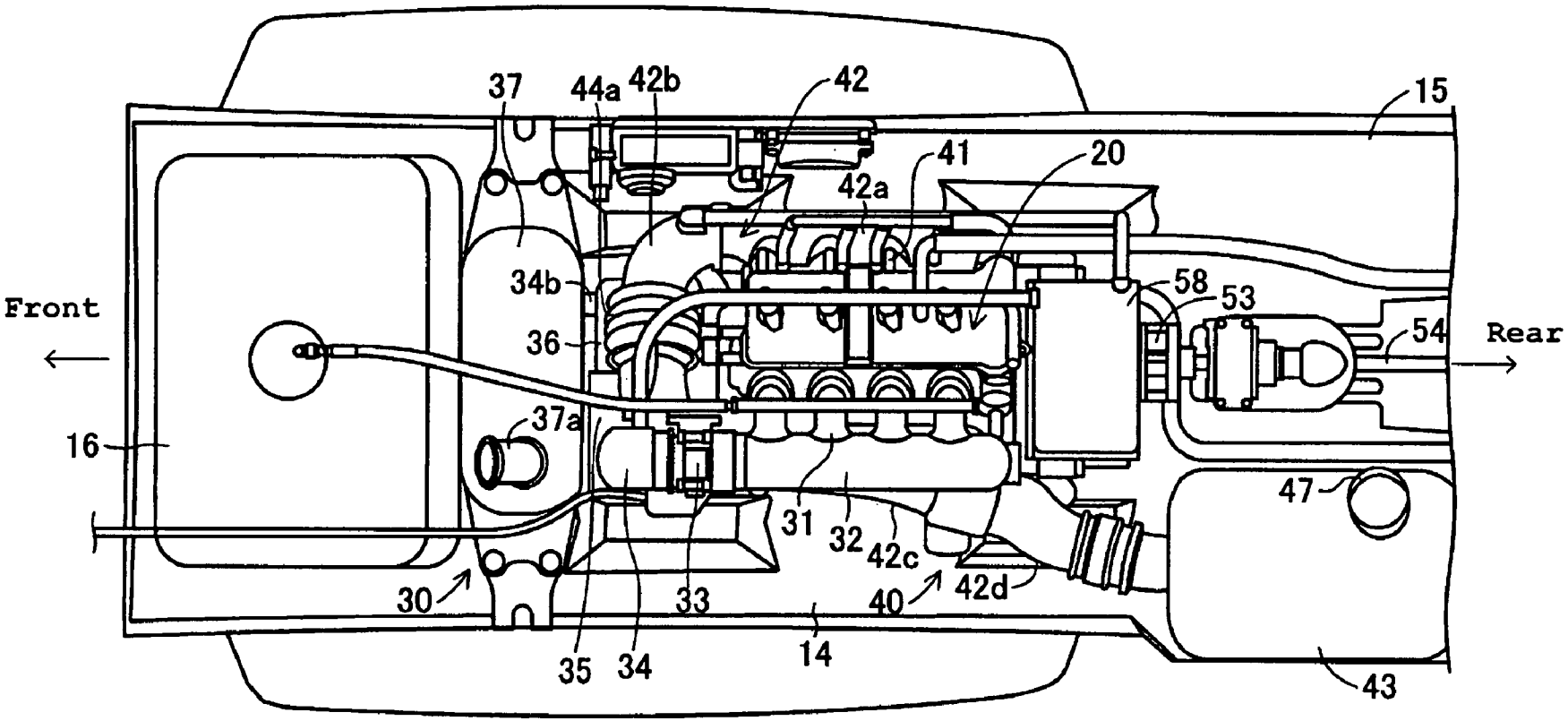
FIG. 4 is an enlarged top plan view of the engine of the watercraft and showing an intake system and exhaust system connected to the engine.
Figure 5:
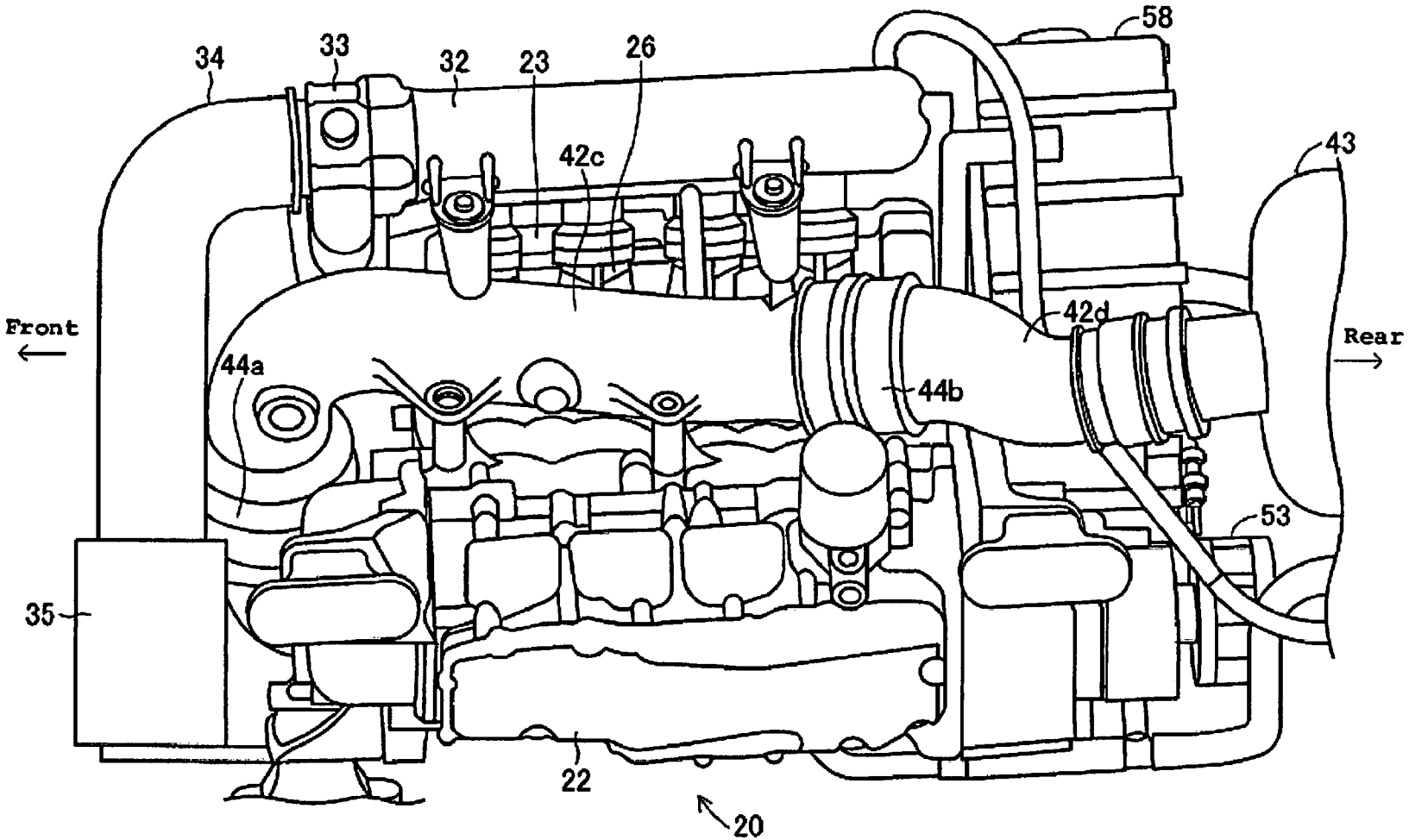
FIG. 5 is a port side elevational view of the engine.
Figure 6:
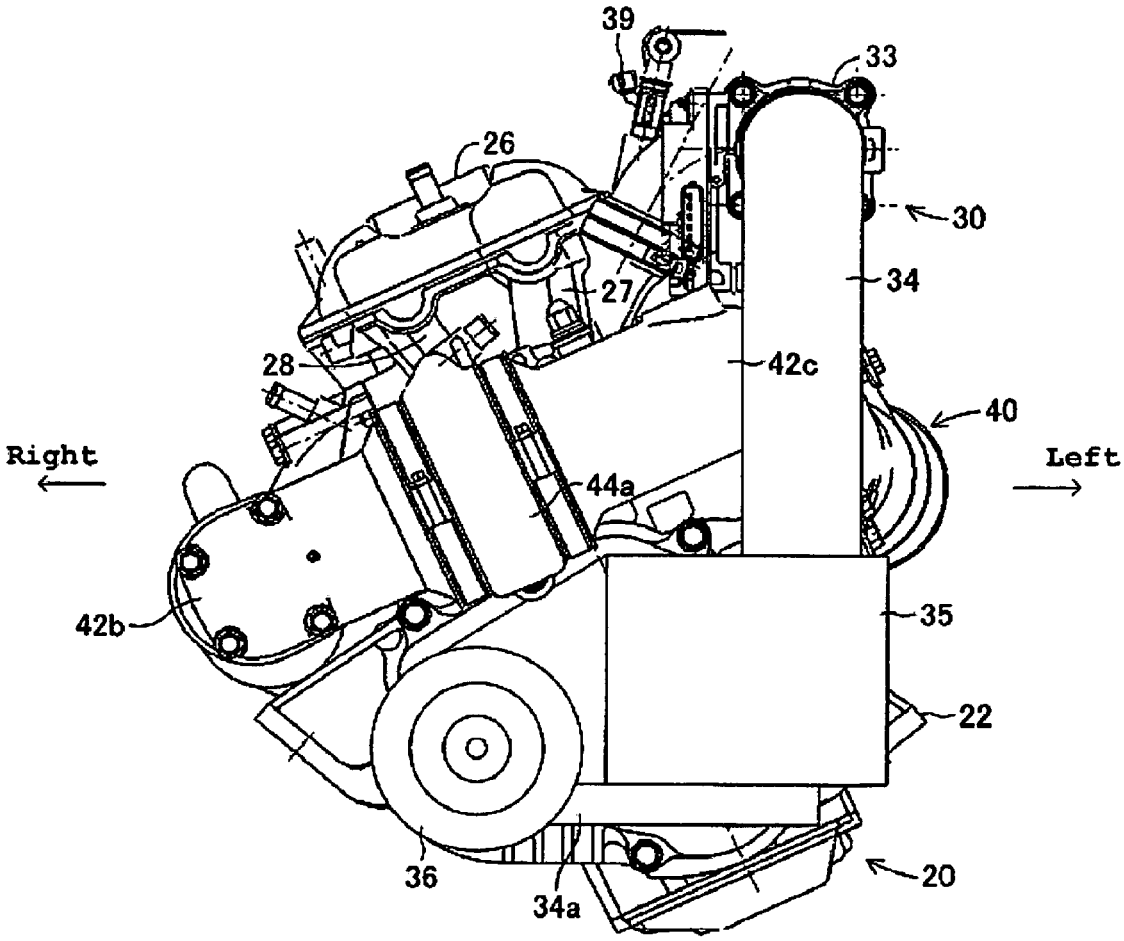
FIG. 6 is a front elevational view of the engine shown in FIG. 5.

FIGS. 4–6 show a configuration and layout of the intake system 30 and the exhaust system 40, which are connected to the engine 20. The intake system 30 can include multi-furcated intake pipes 31 connected to the intake port for each cylinder 26, an intake manifold 32 connected to the upstream end of each furcated intake pipe 31, a throttle body 33 connected to the upstream end of the intake manifold 32, an intercooler 35 connected to the throttle body 33 via an air duct 34, a supercharger 36 connected to the intercooler 35 via an air passage 34*a*, and an intake box 37 connected to the supercharger 36 via an air passage 34*b*, as well as other optional devices. With regard to systems in which fluid or gas flows from one side to the other, for example, the intake system 30 and the exhaust system 40, the term "upstream" refers to the side from which the fluid or gas is supplied, and the term "downstream" refers to the side to which the fluid or gas is supplied.

The intake box 37 can be located between the engine 20 and the fuel tank 16. In the illustrated embodiment, the intake box 37 is disposed slightly closer to the fuel tank 16 with a predetermined distance from the engine 20.

Figure 7:
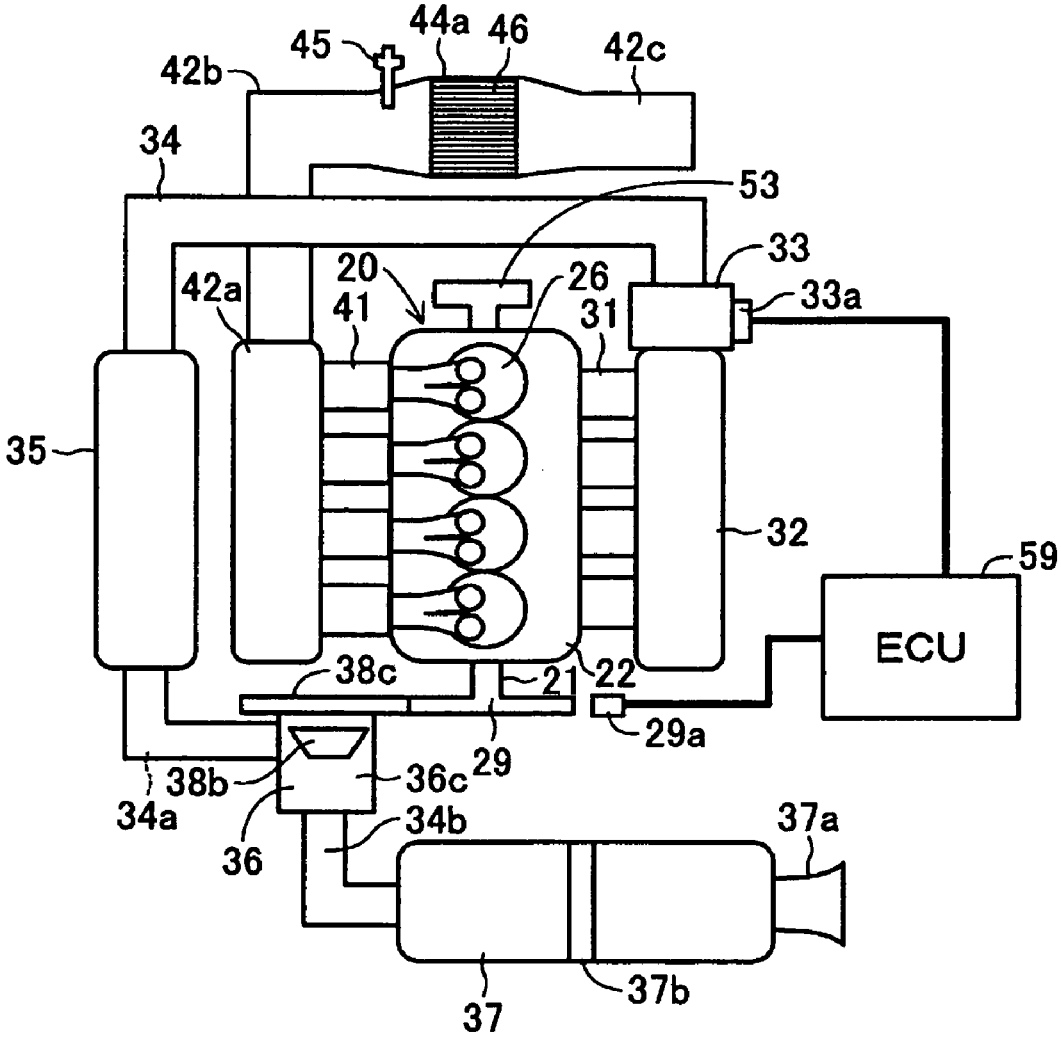
FIG. 7 is a schematic view, showing an intake system and exhaust system connected to the engine.

With reference to FIG. 4, on the upper face of the intake box 37, a curved suction duct 37*a* or an air intake can be located with its opening facing forward. An air filter 37*b* can be disposed within the intake box 37 (FIG. 7).

The intake box 37 is configured to draw, from the suction duct 37*a*, air introduced into the engine compartment 14 through the air ducts 17*a*, 17*b*. The air then passes through the air filter 37*b* to remove foreign matters, and is guided to the supercharger 36 through the air passage 34*b*.

Figure 8:
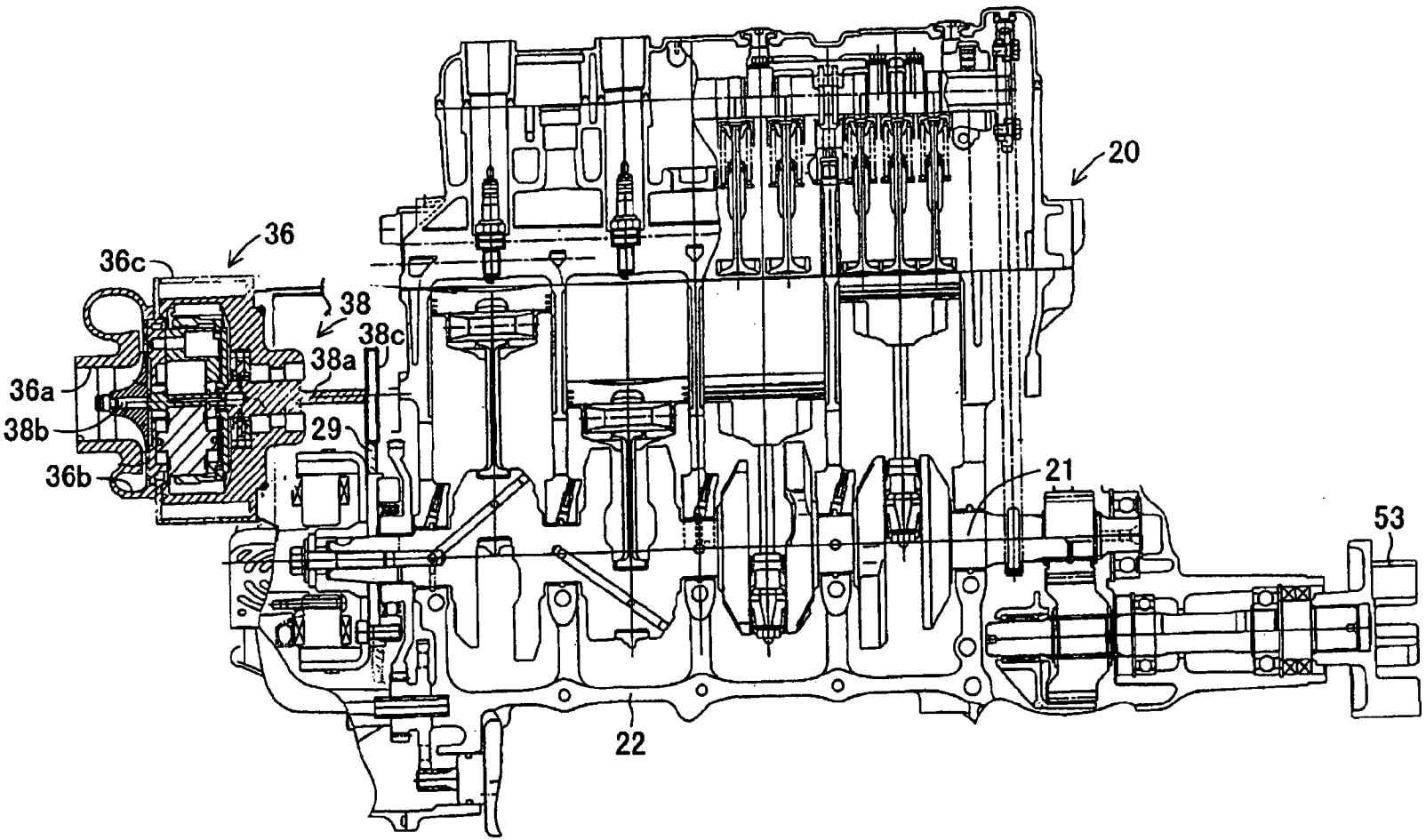
FIG. 8 is a partial sectional and cutaway view, illustrating the engine and a supercharger connected to the engine.

The supercharger 36 can be located closer to the front end of the engine 20 slightly on the starboard side relative to the bottom center of the body 11. As shown in FIG. 8, the supercharger 36 can include a casing 36*c* having an intake port 36*a* connected to the air passage 34*b* for drawing the air fed from the intake box 37 and a discharge port 36*b* connected to the air passage 34*a* for feeding the air drawn from the intake port 36*a* to the intercooler 35. Within the casing 36*c*, a rotary portion 38 is disposed. The rotary portion can include a shaft 38*a* and an impeller 38*b* connected to the front end of the shaft 38*a* for rotation with the rotation shaft 38*a*. The rotary portion 38 can be attached in the casing 36*c* with the impeller 38*b* positioned within the intake port 36*a*.

The shaft 38*a* can have a gear 38*c* connected to its rear end. At the front end of the crankshaft 21 is provided a flywheel 29, which can be engaged with the gear 38*c* to transmit rotational force of the crankshaft 21 to the rotary portion 38. Thus, when the engine 20 operates and the crankshaft 21 rotates, the rotational force is transmitted to the rotary portion 38 via the flywheel 29 and the gear 38*c*, so that the impeller 38*b* can rotate. The rotation of the impeller 38*b* causes the air fed from the air passage 34*b* to the intake port 36*a* to be compressed and discharged from a discharge port 36*b* to the air passage 34*a*.

With reference to FIG. 6, the intercooler 35 can be located beside the supercharger 36 on the front end side of the engine 20 slightly on the port side relative to the bottom center of the body 11. The intercooler 35 can be configured to cool the compressed air, which is fed from the supercharger 36 through the air passage 34*a*, while the compressed air is passing through the interior of the intercooler 35. Cooling the air in such a manner results in an increase in density of the compressed air and thus further enhances combustion performance. The higher-density compressed air can be fed to the throttle body 33 through the air duct 34. The air duct 34, part of the air path, as well as the air passages 34*a*, 34*b*, extends upward from the top surface of the intercooler 35 generally in the vertical direction, and then curves toward the rear to be connected to the throttle body 33.

With reference to FIG. 5, the throttle body 33 can be located forward of the port side face of the engine 20 on its upper side, having a horizontally-rotating shaft and a disk-like throttle valve (not shown) attached to the horizontally-rotating shaft for rotation together. The rotation of the horizontally-rotating shaft allows the throttle valve to open or close the air path in the throttle body 33, thereby adjusting the flow rate of the air to be supplied to each cylinder 26.

A motor, which is not shown, can be mounted adjacent to the throttle body 33, in which the rotation shaft of the motor and the horizontally-rotating shaft are connected via an intermediate gear. The throttle valve therefore rotates with the horizontally-rotating shaft in accordance with the rotation of the motor. The motor can be operated depending on the displacement of a throttle controller provided on a grip of the steering handlebars 12. A throttle sensor 33*a* disposed adjacent to the horizontally-rotating shaft detects the opening of the throttle valve. Optionally, the throttle valve can be operated with a direct mechanical connection between the throttle lever and the throttle valve, without any electric actuators. In some embodiments, the throttle valve can be operated with both direct mechanical and electric actuators.

The intake manifold 32, can be made of resin or aluminum alloy tubing, connected to the rear end of the throttle body 33, and disposed along the upper part of the port side face of the engine 20. Four furcated intake pipes 31 extend from the side face of the intake manifold 32 at a predetermined distance between two adjacent pipes in the longitudinal direction. Each furcated intake pipe 31 can extend obliquely downwardly from its upstream end connected to the intake manifold 32, and leads its downstream end to the intake port for each cylinder 26. Each furcated intake pipe 31 can be a resin tube.

The engine 20 can be supplied with fuel through a fuel supply system from the fuel tank 6. The fuel supply system can include a fuel pump (not shown) and a fuel injector 39. Fuel, which is pumped out of the fuel tank 16 by activating the fuel pump, is atomized and injected by the fuel injector 39 to each cylinder 26. Then, the fuel is mixed, in the multi-furcated intake pipes 31, with the compressed air supplied from the intake box 37 through the supercharger 36. This air-fuel mixture is fed to each cylinder 26. However, this is merely one type of fuel supply system that can be utilized in the watercraft 10. Other fuel supply systems, such as, for example, but without limitation, carbureted systems, as well as other types of fuel injections systems, such as direct injection and or other types of induction system type-injection systems can also be used.

The engine 20 also has an ignition system. The air-fuel mixture with a combustion chamber explodes when it is ignited by the ignition system. The explosions cause the piston 25 to move up and down, thereby rotating the crankshaft 21.

The exhaust system 40 can includes multi-furcated exhaust pipes 41 connected to their respective exhaust ports for each cylinder 26, an exhaust pipe 42 made up of plural pipes connected to the downstream end of each furcated exhaust pipe 41, and a water lock 43 connected to the downstream end of the exhaust pipe 42. As shown in FIGS. 3 and 4, each furcated exhaust pipe 41 extends obliquely downwardly from its upstream end, which is connected to the exhaust port for each cylinder 26, and leads its downstream end to the exhaust pipe 42. The exhaust pipe 42 extends initially forwardly along the bottom and starboard side face of the engine 20, then curves around the front end of the engine 20, and then extends rearwardly along the vertical central part on the port side face.

More specifically, the exhaust pipe 42 can include a first muffler 42*a* connected to the downstream end of each furcated exhaust pipe 41, an elbow portion 42*b* connected to the downstream end of the first muffler 42*a*, a second muffler 42*c* connected to the downstream end of the elbow portion 42*b*, and an exhaust hose 42*d* connected to the downstream end of the second muffler 42*c*. The first muffler 42*a* can be disposed along the bottom and starboard side face of the engine 20. Its rear end, that is, its upstream end, is closed while its front end reaches a position corresponding to the front end of the engine 20.

The downstream end of the first muffler 42*a* can be connected to the upstream end of the elbow portion 42*b*, which can be curved at about a 90-degree angle relative to the advancing direction. The elbow portion 42*b* can extend obliquely upwardly while curving along a corner of the body of the engine 20, until its downstream end reaches generally the center of the front face of the engine 20 as shown in FIG. 6. The second muffler 42*c* can be connected to the downstream end of the elbow portion 42*b* via a joint 44*a*. The joint 44*a* can be referred to as a ring joint, which includes an inner-most passage for carrying exhaust gasses and an annular passage extending around the inner-most passage for carrying coolant. The second muffler 42*c* initially extends obliquely upward along the front face of the engine 20, and then extends rearwardly along generally the vertical center of the port side face of the engine 20.

In other words, part of the elbow portion 42*b* and second muffler 42*c*, located forwardly of the engine 20, extends obliquely upwardly from its upstream to downstream so as to cover the upper surface of the supercharger 36 and the intercooler 35. The second muffler 42*c* can be positioned below the intake manifold 32. The downstream end of the second muffler 42*c* can be connected to the upstream end of the exhaust hose 42*d* via a joint 44*b*, and the downstream end of the exhaust hose 42*d* is connected to the water lock 43.

The first muffler 42*a*, elbow portion 42*b* and second muffler 42*c* can be made of two-layer aluminum pipe. In other words, each of the first muffler 42*a*, elbow portion 42*b* and second muffler 42*c* can include an inner-most passage for carrying exhaust gasses and an outer annular passage for carrying coolant. As such, the coolant can be used to cool the exhaust gasses flowing through the inner-most passage. This type of construction is well-known in the art.

Figure 9:
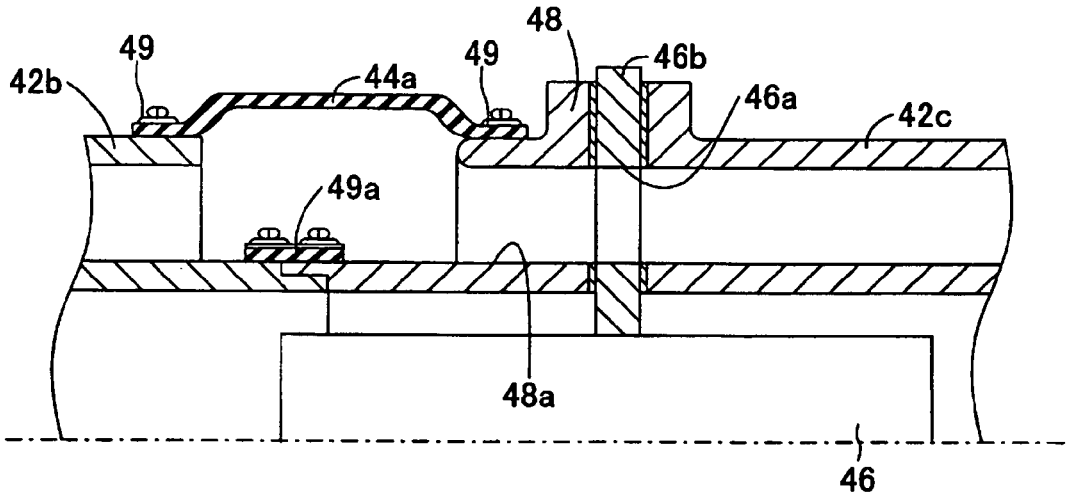
FIG. 9 is a sectional view illustrating a catalyst device attached to the exhaust system.

As shown in FIGS. 7 and 9, an oxygen detecting sensor 45 configured for detecting oxygen in combustion gas, and a catalyst 46 for purifying the combustion gas, can be attached to the interior of an area adjacent to the connection portion of the joint 44*a* and the second muffler 42*c* on the exhaust pipe 42. The catalyst 46 can include a honeycomb catalyst element with a base material coated with platinum to purify the exhaust gas passing through the catalyst element. For example, the catalyst element can be configured to oxidize unburned hydrocarbons, as well as other gasses.

During operation, if the quantity of oxygen detected by the oxygen detecting sensor 45 is equal to or lower than a predetermined value, for example, so that the catalyst 46 can not burn unburned gas (hydrocarbons), an ECU 59, to be discussed later, can be configured to control or decrease the quantity of fuel to be supplied in order to secure sufficient quantity of oxygen.

As shown in FIG. 9, a fixing flange 46*b* can be provided with a cooling water passage hole 46*a*, can be disposed on the outside circumferential surface of the catalyst 46. One of the faces of the flange 46*b* can be jointed to the end of the second muffler 42*c*. The other face of the flange 46*b* can be joined to a ring-shaped fixing member 48 provided with the cooling water passage hole 48*a*.

The flange 46*b* can be fixed, via the fixing member 48, to the end of the elbow portion 42*b*, which allows the catalyst 46 to be attached between the elbow portion 42*b* and the second muffler 42*c*. Joining the second muffler 42*c*, flange 46*b* and fixing member 48 together is achieved by using bolts (not shown), and packing is used between the members.

The joint 44*a* can be a rubber tube, which covers a gap on the outside circumferential surface between the elbow portion 42*b* and the fixing member 48. Additionally, the joint 44*a* can connect the cooling water passages of the elbow portion 42*b* and the second muffler 42*c*.

A gap can be formed between the outside circumferential surface of the catalyst 46 and the inside circumferential surface of the second muffler 42*c*. The gap can be configured to insulate the catalyst 46 from the cooling water passing through the cooling water passages, so as to prevent the catalyst from being excessive cooled by the cooling water.

Each joint portion between the joint 44*a* and the elbow portion 42*b* as well as between the joint 44*a* and the fixing member 48 can be secured with respective fixing members 49*a*, 49, 49.

The water lock 43 can be formed as a large-diameter cylindrical tank. Additionally, the water-lock 43 can include internal walls and/or baffles to attenuate exhaust sounds as well as suppress upstream movement of water. An exhaust gas pipe 47 can extend rearwardly from the rear top surface of the water lock 43.

The upstream end of the exhaust gas pipe 47 is connected with the water lock 43 on its top face. A downstream portion of the pip 47 initially extends upwardly, and then extends downwardly toward the rear as shown FIGS. 1 and 2. The downstream end of the exhaust gas pipe 47 is open toward a hull tunnel 52 that separates the propulsion unit 50 from the main unit of the body 11, and has access to the outside at the rear end of the body 11. In some embodiments, the pipe 47 ends at a discharge port (not shown) disposed on a side wall of the hull tunnel 52 within which the propulsion unit 50 is disposed. The port can be positioned so as to be submerged during low speed maneuvers (when the watercraft 10 is floating in a displacement mode) and to be above water when the watercraft 10 is planing.

From the rear of the engine 20, a pump drive shaft 54 connected to the crankshaft 21 via a coupling 53 extends rearward to the pump compartment 15. The pump drive shaft 54 is connected to an impeller (not shown) provided inside a jet pump 51 disposed at the stern of the body 11, and transmits the rotational force of the crankshaft 21 driven by the engine 20 to the impeller to rotate. In some embodiments, the pump drive shaft 54 can be a single shaft, or a plurality of shafts connected together.

The jet propulsion unit 50 provided with the jet pump 51 is disposed generally on the center line of the watercraft 10, at the rear end thereof. The propulsion unit 50 can have a water inlet 55 located at the bottom of the body 11 and a water jet nozzle 56 with its opening located at the stern. Seawater introduced from the water inlet 55 is ejected from the water jet nozzle 56 by the impeller of the jet pump 51 to generate thrust for the body 11.

The propulsion unit 50 can be installed at the bottom at the stern of the body 11 while being separated by the hull tunnel 52 from the main unit of the body 11. Typically, the propulsion unit 50 is housed in a hull tunnel formed at the rear end of the hull 11*b*. Thus, the pump drive shaft 54 passes through the casing 52 and extends from the engine 20 to the jet pump 51 of the propulsion unit 50.

In addition, a steering nozzle 57 can be attached to the rear end of the jet pump 51 to change the direction of the watercraft 10 to right or left. For example, the steering nozzle 57 can be moves right or left in response to the operations of the steering handlebars 12.

An oil tank 58 can be provided at the rear of the engine 20 to supply lubricating oil to the engine 20. The lubricating oil supplied from the oil tank 58 prevents the engine 20 from seizure and allows it to achieve smooth operations.

Besides the aforementioned systems, the watercraft 10 can include various devices for operation, such as an electrical component box accommodating an electronic control unit (ECU) 59. The ECU 59 can include a CPU, ROM, RAM and timer, and various electrical components, as well as a start switch and various types of sensors.

A pulser 29*a* can be configured to detect a rotational speed of the flywheel 29. The pulser 29*a*, which is also known as an "engine speed sensor" can be provided in the vicinity of the flywheel 29. An engine speed value detected by the pulser 29*a* is sent to the ECU 59 as a signal. Also, a value detected by the throttle sensor 33*a* is sent to the ECU 59 as a signal. Based on these detected values, the ECU 59 can control the operation of the engine 20. The watercraft 10 additionally has cooling water passages for cooling the aforementioned systems.

During operation of the watercraft 10 constructed as above, a rider straddles the seat 13 and turns the start switch on, which makes the watercraft 10 ready for traveling. The rider then steers the steering handlebars 12 and operates the throttle controller on the grips of the steering handlebars 12. Accordingly, the watercraft 10 runs in a desired direction at a desired speed.

When the engine 20 is running, ambient air enters the engine compartment 14 through the air ducts 17*a*, 17*b*. This air is drawn into the intake box 37 through the suction duct 37*a*, and is then fed to the supercharger 36 through the duct 34*b*. The air is compressed by the supercharger 36 and is then fed to the intercooler 35 through the air duct 34*a* as compressed air to the throttle body 33.

The throttle body 33 controls the flow rate of this compressed air. The compressed air passes through the intake manifold 32 and then through each furcated intake pipes 31 to be supplied to the associated cylinder 26.

In the meantime, the compressed air is mixed with fuel fed from the fuel tank 16 in each furcated intake pipe 31. The air-fuel mixture explodes within the cylinder 26 as it is ignited by the ignition system in order to drive the engine 20. The rotational force of the crankshaft 21 obtained by the driving force of the engine 20 is transmitted to the pump drive shaft 54 for driving the propulsion unit 50. Then, if the seawater enters the interior of the body 11 and stays at the bottom of the body, it is stirred up and splashes around due to the rotations of the coupling 53.

Thus, even when the water is splashed by the coupling 53, the watercraft 10 prevents the splashes from the coupling 53 from splashing onto the supercharger 36 or the joint portion between the casing 36*c* of the supercharger 36 and the crankcase 22 of the engine 20, because the supercharger 36 disposed forward of the rear side of the engine 20. In other words, the coupling 53 and the supercharger 36 are placed on the opposite sides relative to the rear side of the engine 20, which prevents or suppresses splashes from the coupling 53 from reaching the supercharger 36 and it connection to the engine 20.

A further advantage is provided where a portion of the exhaust system is disposed above the supercharger 36. For example, but without limitation, the elbow portion 42*b* and/or the second muffler 42*c* of the exhaust pipe 42 can be placed above the supercharger 36. This allows the engine 20 to serve as a shield wall while allowing the exhaust pipe 42 to serve as an umbrella so that they can protect the supercharger 36 and its adjacent area from the seawater. In addition, the intercooler 35 can also be protected from the seawater.

The combustion gas, generated in each cylinder 26 by the explosion of the air-fuel mixture, is discharged through the multi-furcated exhaust pipes 41 joined to the exhaust port of each cylinder 26 into the first muffler 42*a*. The combustion gas is fed from the first muffler 42*a* through the elbow portion 42*b*, the second muffler 42*c* and the exhaust hose 42*d* to the water lock 43, and then discharged out of the boat through the exhaust gas pipe 47.

As described above, in the watercraft 10, the supercharger 36 is located forward of the crankcase 22 of the engine 20. Additionally, the elbow portion 42*b* and the second muffler 42*c* on the exhaust pipe 42 are placed above the supercharger 36. This can protect the supercharger 36 and its joint portion with the engine 20 from the seawater splashing around due to the rotations of the coupling 53. This can also prevent the seawater from entering the interior of the supercharger 36 and the engine 20 if the sealing performance for the joint portion between the supercharger 36 and the engine 20 is impaired by cracks caused by heat cycle.

The intake box 37 located forward of the engine 20, and the forward-facing opening of the suction duct 37*a* on the intake box 37 can prevent the water splashing around due to the rotations of the coupling 53 from entering into the intake box 37. In addition, the intake box 37 is provided close to the forward part of the supercharger 36, and connected to the supercharger 36 via the relatively short air passage 34*b*. This can reduce path resistance in the air passage 34*b*. This results in improvement in intake efficiency and reduction in loss of engine output, particularly, at the acceleration.

In the watercraft 10 illustrated in FIGS. 1–9, the supercharger 36 and the intercooler 35 are laterally aligned respectively on the left and right in front of the engine 20. The supercharger 36 compresses the air and the intercooler 35 cools it, which increases the density of the compressed air to be fed to the engine 20. This leads to an increase in output of the engine 20.

The supercharger 36 and the intercooler 35 are closely connected to each other via the relatively short air passage 34*a*, which decreases the path resistance in the air passage 34*a* and therefore improves intake efficiency. This also results in reduction in loss of the engine output. Further, the intercooler 35 is located below the air duct 34 connected to the throttle body 33, which makes it easier to connect the intercooler 35 and the air duct 34.

With the exhaust system arrangement noted above, the exhaust pipe initially extends forward from the exhaust passage, then curves along the front end of the crankcase and extends rearward, and that the supercharger is positioned forward of the crankcase and below the curved portion of the exhaust pipe. This allows the supercharger to be placed forward of the crankcase relative to the coupling positioned rearward of the crankcase while further protecting the supercharger from the water since the exhaust pipe is positioned above the supercharger. In this case, the wording "forward of the crankcase" means "forward of the front end of the crankcase".

Figure 10:
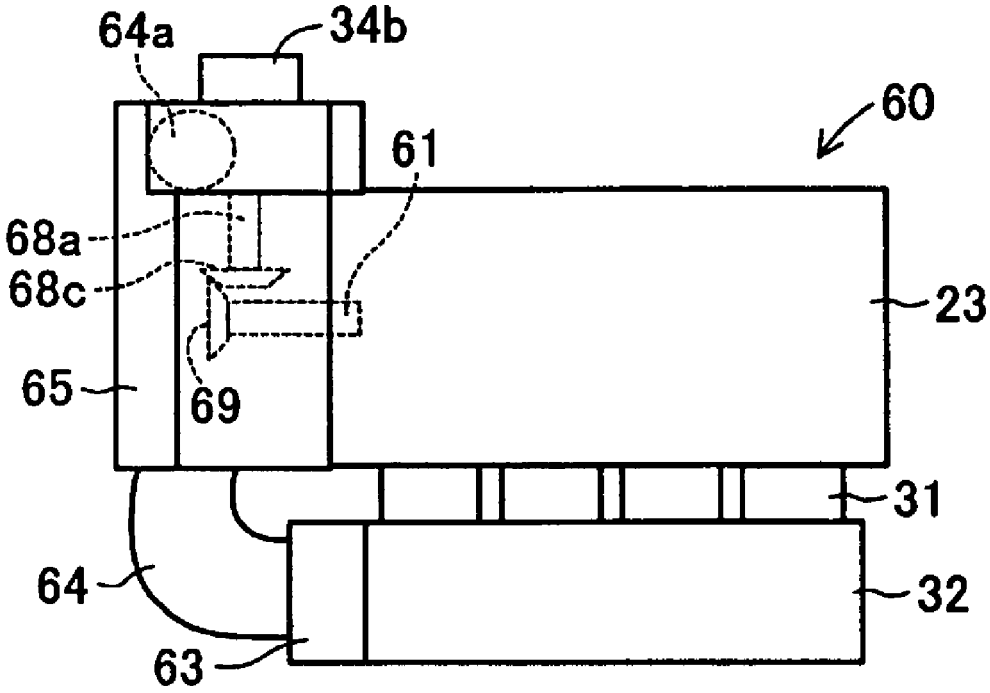
FIG. 10 is a schematic plan view of a modification of the engine illustrated in FIGS. 1–9, showing the arrangement of a supercharger and an intercooler.
Figure 11:
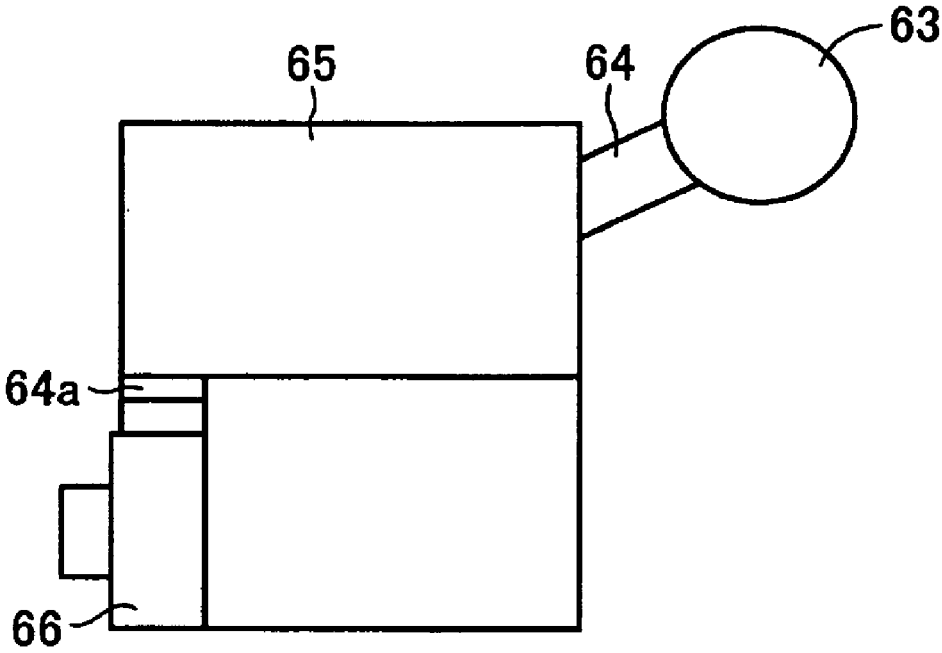
FIG. 11 is a schematic front elevational view of the engine illustrated in FIG. 9.
Figure 12:
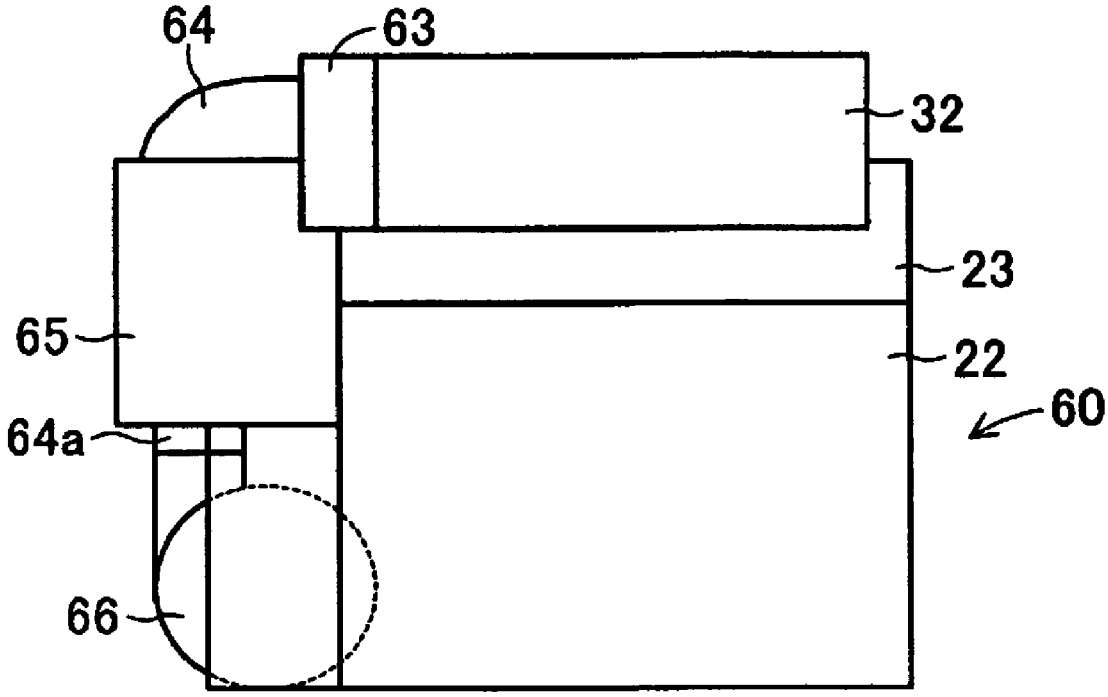
FIG. 12 is a side elevational view of the engine illustrated in FIG. 9.

FIGS. 10–12 show a modified arrangement of a supercharger 66 and an intercooler 65 that can be used in the watercraft 10. In this arrangement, the supercharger 66 is located forward of the crankcase 22 of the engine 60 such that a rotation shaft 68*a* of the supercharger 66 and a crankshaft 61 of an engine 60 are perpendicular to each other. Thus, a gear 68*c* is engaged with and is disposed with its axis normal to a rotational axis of the flywheel 69.

In this embodiment, the intercooler 65 is disposed above the supercharger 66. Thus, an air passage 64*a*, for connecting the supercharger 66 and the intercooler 65 to each other, extends generally vertically. In addition, since the intercooler 65 is positioned higher, an air duct 64 for connecting the intercooler 65 and a throttle body 63 to each other is made up of a short pipe.

Other features of the watercraft 10, except for the modifications described above with reference to FIGS. 10–12, can be the same as the configurations described above with reference to FIGS. 1–9. Therefore, the corresponding parts are denoted with the identical reference numerals.

In the watercraft using the modifications of FIGS. 10–12, a shorter air passage 64*a* or air duct 64 can be used for compact layout of the supercharger 66 and the intercooler 65. Other functions and effects of the watercraft of FIGS. 10–12 are the same as those for the aforementioned watercraft of FIGS. 1–9.

The watercraft 10 is not limited to the embodiments described above and can be practiced involving appropriate modifications. For instance, the supercharger 36 or 66 can be disposed at least forward of the rear end of the crankcase 22 of the engine 20, such as the side of the engine 20 or 60, in contrast to the aforementioned embodiments in which the supercharger 36 or 66 is disposed forward of the engine 20 or 60. This also allows the crankcase 22 to serve as a shield wall and therefore protects the supercharger 36 or 66 from seawater.

In addition, the layout of the intercooler 35 or 65 can also be modified according to the layout of the supercharger 36 or 66. However, it is preferable that the intercooler 35 or 65 is placed closed to both the supercharger 36 or 66 and the air duct 34 or 64.

Although the supercharger 36 or 66 is designed to use driving force of the engine 20 or 60 in the aforementioned embodiments, it can be replaced with a turbo charger designed to be driven by exhaust gasses flowing through the exhaust system. Further, the layout, structure and materials of the rest components in the watercraft according to the present invention may be modified as appropriate within the technical scope of the inventions.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A watercraft comprising an engine, an intake passage configured to guide air to the engine, an exhaust passage configured to guide exhaust gasses away from the engine, the engine including a crankshaft, the crankshaft being connected to an output shaft so as to transmit power rearwardly from a rear end of a crankcase of the engine, and a supercharger configured to compress air to feed the compressed air to the intake passage, wherein the supercharger is located forward of the rear end of the crankcase in the watercraft.

2. The watercraft according to claim 1, additionally comprising at least one exhaust pipe extending from the exhaust passage, wherein the supercharger is disposed below at least a portion of the exhaust pipe.

3. The watercraft according to claim 2, wherein the exhaust pipe initially extends forward from the exhaust passage, then curves along a front end of the crankcase and then extends rearwardly, the supercharger being positioned forwardly of the crankcase and below the curved portion of the exhaust pipe.

4. The watercraft according to claim 1 additionally comprising an engine compartment in which the engine is disposed, and an air intake disposed in the engine compartment forward from the rear end of the crankcase, such that the air in the engine compartment is introduced from the air intake to the supercharger.

5. The watercraft according to claim 2 additionally comprising an engine compartment in which the engine is disposed, and an air intake disposed in the engine compartment and forward of the rear end of the crankcase, such that the air in the engine compartment is introduced from the air intake to the supercharger.

6. The watercraft according to claim 3 additionally comprising an engine compartment in which the engine is disposed, and an air intake disposed in the engine compartment and forward of the rear end of the crankcase, such that the air in the engine compartment is introduced from the air intake to the supercharger.

7. The watercraft according to claim 4 additionally comprising an intake box, the supercharger and the intake box being disposed forward of the crankcase in the engine compartment, and the air introduced from the air intake is fed to the supercharger via the intake box.

8. The watercraft according to claim 7, wherein the intake box and the supercharger are arranged in the longitudinal direction of the watercraft such that the intake box is positioned forward of the supercharger.

9. The watereraft according to claim 1 additionally comprising an intercooler, the supercharger and the intercooler being located forward of the crankcase in the engine compartment, wherein air is fed from the supercharger to the intake passage through the intercooler.

10. The watercraft according to claim 9, wherein the supercharger and the intercooler are aligned in the lateral direction of the watercraft.

11. The watercraft according to claim 8, wherein the intercooler is placed on the intake passage side in the lateral direction of the watercraft.

12. A watercraft comprising an engine, an intake system configured to guide air to the engine for combustion in the engine, an exhaust system configured to guide exhaust gasses away from the engine, the engine including a crankshaft, the crankshaft being connected to an output shaft so as to transmit power from a crankcase of the engine, and a supercharger configured to compress air to feed the compressed air to the intake passage, wherein at least a portion of the exhaust system extends over the supercharger.

13. The watercraft according to claim 12, wherein said portion of the exhaust system extends over a joint between the supercharger and the intake system.

14. The watercraft according to claim 12, wherein said portion of the exhaust system is arranged so as to shield the joint from water dropping downwardly toward the joint.

15. The watercraft according to claim 14, wherein said portion of the exhaust system extends directly over the joint.

16. The watercraft according to claim 14, wherein said portion of the exhaust system extends directly over the supercharger.

17. The watercraft according to claim 14, wherein the output shaft is driven from a rear end of the crankshaft.

* * * * *

UNITED STATES PATENT AND TRADEMARK OFFICE

CERTIFICATE OF CORRECTION

PATENT NO. : 7,343,906 B2
APPLICATION NO. : 11/154490
DATED : March 18, 2008
INVENTOR(S) : Shigeyuki Ozawa It is certified that error appears in the above-identified patent and that said Letters Patent is hereby corrected as shown below:

On Page 3, Col. 2 (Foreign Patent Documents), Line 21, Delete "11/1985" and insert -- 3/1987 --, therefor.

On Page 4, Col. 1 (Foreign Patent Documents), Line 22, Delete "11/1998" and insert -- 1/1998 --, therefor.

On Column 2, Line 66, Delete "11b ." and insert -- 11b. --, therefor.

On Column 5, Line 38, Delete "6." and insert -- 16. --, therefor.

On Column 12, Line 10, In Claim 9, delete "watereraft" and insert -- watercraft --, therefor.

Signed and Sealed this

Eighteenth Day of November, 2008

JON W. DUDAS
*Director of the United States Patent and Trademark Office*